US006817614B2

(12) United States Patent
Ibbertson

(10) Patent No.: US 6,817,614 B2
(45) Date of Patent: Nov. 16, 2004

(54) METHOD OF CONDUCTING A WAGERING GAME

(75) Inventor: Steven Ibbertson, Henderson, NV (US)

(73) Assignee: Sterling Gaming, LLC, Las Vegas, NV (US)

( * ) Notice: Subject to any disclaimer, the term of this patent is extended or adjusted under 35 U.S.C. 154(b) by 0 days.

(21) Appl. No.: 10/121,517

(22) Filed: Apr. 12, 2002

(65) Prior Publication Data

US 2003/0193138 A1 Oct. 16, 2003

(51) Int. Cl.[7] ..... A63F 3/00
(52) U.S. Cl. ..... 273/292; 273/138.1; 463/13
(58) Field of Search ..... 273/292, 138.1, 273/139, 138.2; 463/13, 14, 16–20

(56) References Cited

U.S. PATENT DOCUMENTS 4,861,041 A * 8/1989 Jones et al. ..... 273/292
5,078,405 A * 1/1992 Jones et al. ..... 463/27
5,100,137 A * 3/1992 Fulton ..... 463/13
5,511,781 A * 4/1996 Wood et al. ..... 463/13
5,542,669 A 8/1996 Charron et al.
5,573,249 A 11/1996 Johnson
5,851,147 A 12/1998 Stupak et al.
5,868,618 A 2/1999 Netley et al.
5,882,259 A 3/1999 Holmes, Jr. et al.
5,975,529 A * 11/1999 de Keller ..... 273/292
6,068,552 A 5/2000 Walker et al.
6,135,453 A * 10/2000 Srichayaporn ..... 273/292
6,206,373 B1 * 3/2001 Garrod ..... 273/292
6,227,969 B1 5/2001 Yoseloff
6,311,979 B1 * 11/2001 Andrews ..... 273/292
6,325,375 B1 12/2001 Potter et al.
6,379,245 B2 * 4/2002 De Keller ..... 463/13
6,402,148 B1 * 6/2002 Saruwatari ..... 273/292
6,402,150 B1 * 6/2002 Jones ..... 273/292
6,416,407 B1 7/2002 Carrico et al.
6,419,578 B1 7/2002 Moody et al.
6,454,651 B1 9/2002 Yoseloff
6,467,771 B1 * 10/2002 deKeller ..... 273/274
6,550,772 B1 * 4/2003 Streeks et al. ..... 273/292
2001/0054794 A1 12/2001 Cole et al.
2002/0020965 A1 2/2002 Potter et al.
2002/0037762 A1 3/2002 Wood et al.

* cited by examiner

*Primary Examiner*—Jessica Harrison
*Assistant Examiner*—Alex F. R. P. Rada, II
(74) *Attorney, Agent, or Firm*—Robert Ryan Morishita; Anderson & Morishita, LLC

(57) ABSTRACT

A game method for providing a mid-game wager for a base game begins with designating an intermediate game point, a qualifying intermediate holding, and a qualifying final result. Players place a base game wager and initiate the base game. The base game is played the designated intermediate game point is reached. A player holding a qualifying intermediate holding at the intermediate game point may place an optional mid-game wager. The base game is played to completion. Players with a final holding that is a qualifying final result are rewarded based on the mid-game wager.

12 Claims, 2 Drawing Sheets

METHOD OF CONDUCTING A WAGERING GAME

FIELD OF THE INVENTION

The present invention relates to wagering games. Specifically the present invention is a game method that may be applied to a variety of wagering games to permit a separate mid-game wager during game play for qualifying intermediate holdings.

BACKGROUND OF THE INVENTION

A game well known in the gambling industry is video poker. In the conventional game of video poker known in the art, a gaming machine with an incorporated data processor and display is provided. The gaming machine receives a player's wager thereby prompting the data processor to randomly select a hand of cards from a data structure containing data representing a deck of playing cards. The hand of cards, typically five cards, is displayed face up to represent an initial hand.

The player selects which, if any, of the five cards of the initial hand to hold and prompts the processor, through an input device, to discard the remaining cards. The data processor replaces the discarded cards with cards selected from the data structure containing data representing a deck of cards depleted of the initial hand. The replacements along with the held cards form a final hand.

The video poker device compares the final outcome to a set of pre-determined winning combinations stored in the data structure. Typically, these combinations represent the conventional ranked Poker hands such as a pair of Jacks or better, two pair, three of a kind, and so forth. If the player's final outcome matches a winning combination, the player is rewarded according to a predetermined fixed paytable. Otherwise, the final outcome is deemed to be a loss and the player's wager is retained by the gaming machine.

Another gaming machine known in the art is a slot machine. A slot machine includes a random number generator, which can be either mechanical or electronic, and a set of reels, which also can be either mechanical or electronic. Symbols or symbol sets are randomly selected by the random number generator. If a winning combination of symbols appears on a designated payline, the player is rewarded. If no winning combinations appear on a designated payline, the player's wager is retained by the gaming machine.

It is known in the art that players are attracted to games in which a larger payout is possible. Thus, several methods have been developed to improve payouts for video poker, slot machines, and other wagering games. Two of these methods are secondary games and jackpots.

Secondary games are separate games which are activated by some triggering event occurring during or after the play of a primary game. For example, one secondary game for slot machines is triggered by a designated symbol appearing on the display. Upon triggering, a bonus screen appears in which the gaming machine randomly selects, or a player selects, one or more bonus symbols from a bonus symbol set. Depending on the bonus symbols selected, a bonus is awarded. Rather than a fixed bonus, it is also known to provide a bonus multiplier that multiplies the winnings of the primary game.

Secondary games have also been developed for video poker. For example, one secondary game developed for video poker is triggered if the player has a winning combination. The secondary game is optional and requires no additional wager in exchange for the chance to double the player's winnings.

In the secondary game, one dealer card is displayed face up and four player cards are displayed face down. The player is rewarded when the player selects a player card with a higher value than the dealer card. When the player selects a player card with a lower value than the dealer card, the player loses the amount won from the primary game. The drawbacks of this system are that the player must risk the player's winnings to play the secondary game and the outcome of the secondary game is not tied to the outcome of the primary game.

Progressive jackpots also encourage continued play by making the game exciting, suspenseful, and entertaining. In such a jackpot, a portion of each primary wager is allocated to a progressive jackpot. The prize is generally awarded based on the ultimate outcome of the primary game. However, the odds of obtaining a progressive jackpot are very low.

Thus, it can be seen that there is a need in the art for a method for increasing the payouts of a game such as video poker, slot machines, and other wagering games.

SUMMARY OF THE INVENTION

The present method may be applied to any gaming game. The game method begins with designating an intermediate game point, a qualifying intermediate holding, and a qualifying final result.

A player makes a base game wager and initiates the base game. The base game is played in conventional fashion according to the rules governing play of the base game until reaching the predetermined intermediate game point. If the player possesses a predetermined qualifying intermediate holding at the intermediate game point, the player is permitted to place a mid-game wager.

The base game is played to completion and the player is rewarded, if at all, based on his base game wager for his or her final holding. If the final holding is also a predetermined qualifying final result, the player is also rewarded based on his or her mid-game wager.

DESCRIPTION

Reference is now made to the figures wherein like parts are referred to by like numerals throughout. The game method of the present invention could be applied to any of a variety of base games including, but not limited to, video poker, slot machines, Keno machines, or the like. Likewise, it is contemplated that the present invention could be applied to games played via computer network, such as the Internet, as well as to live games and gaming machines. Thus, it should be noted that the description of the optional embodiments below is exemplary of the claims rather than limiting.

Figure 1:
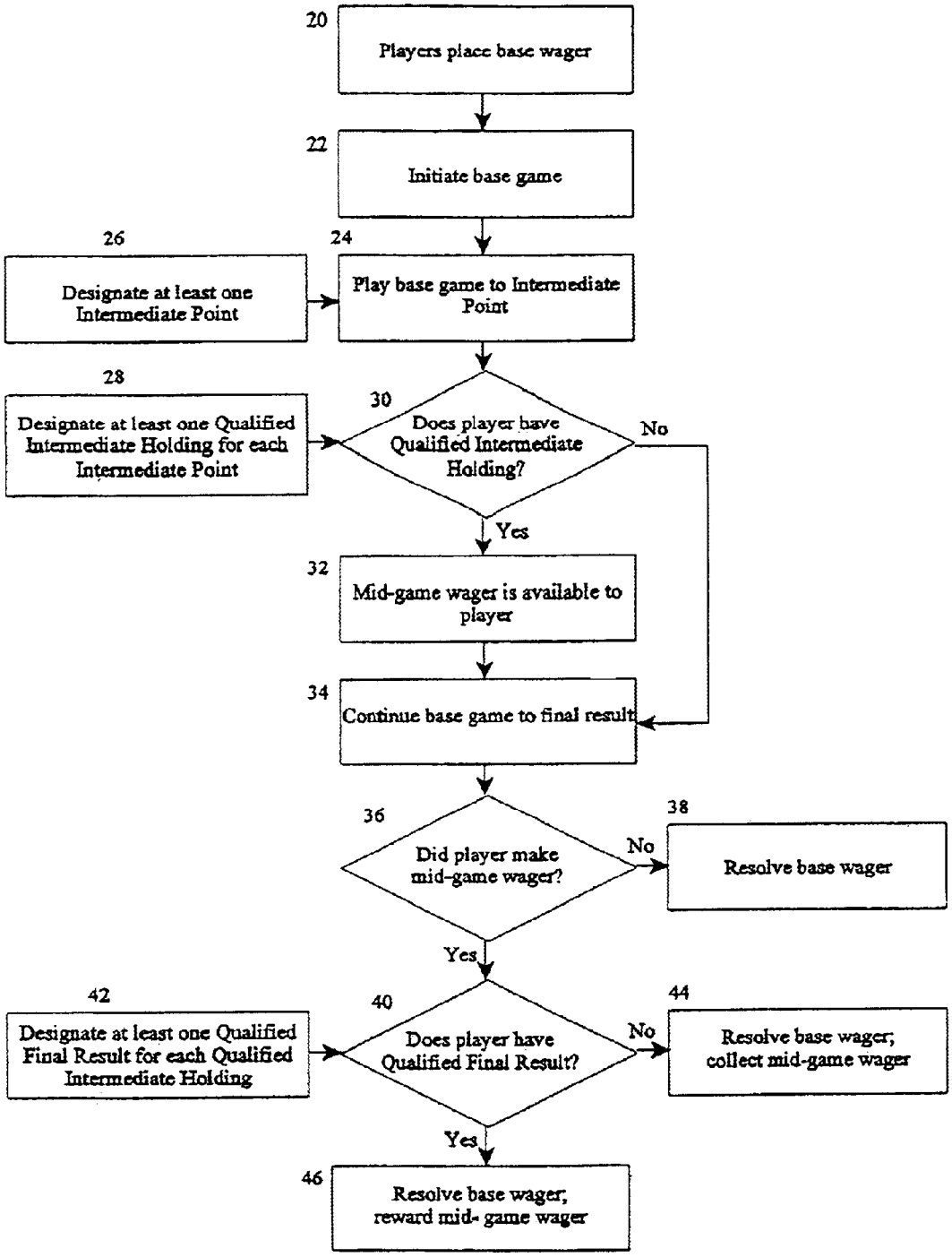
FIG. 1 is a flowchart of a gaming method according to an embodiment of the present invention.

Referring to FIG. 1, the broad game method begins with designating at least one intermediate point 26 for the game, at least one qualifying intermediate holding 28 for each intermediate point 26 designated, and at least one qualifying final result 42 for each qualifying intermediate holding 28 designated. The selection of the intermediate point, a qualifying intermediate holding, and a qualifying final result may be fixed and predetermined by the rules of the game, may vary in some fashion, including random, from play to play, or may depend in whole or in part upon player input prior to initiating game play.

The designated intermediate point 26 depends upon the base game. It is contemplated that the intermediate point could be any predetermined point in the game between wagering and resolution. It is further contemplated that in an optional embodiment, more than one intermediate point may be designated.

For example, for a video draw poker machine, the intermediate point may be after the initial deal but before cards are discarded and replaced. Likewise, for a slot machine, the intermediate point may be after some, but fewer than all, the slot reels have stopped spinning. It is noted that the intermediate point may be fixed or may vary depending upon game play of a specific game. Thus, for some symbols, the intermediate point may be when one symbol appears, for other symbols, the intermediate point may be when two symbols appear. Similarly, in a Keno machine, the intermediate point may be after some, but fewer than all, the numbers have been drawn.

A qualifying intermediate holding is also designated 28. The qualifying intermediate holding is the holding required at the predetermined intermediate point to participate in the mid-game wager of the present invention. It should be noted that more than one qualifying intermediate holding may be designated. Again, the qualifying intermediate holding will vary depending on the base game. However, the qualifying intermediate holding forms the basis for a recognized outcome.

For example, in video poker the qualifying intermediate holding may be any one, two, three, four, or five card hand such as three or four cards to a Royal Flush, a three of a kind, four cards to a straight, or the like. Similarly, in a slot machine, the qualifying intermediate holding may be any designated number of reels with any designated symbols in a designated position such as two reels with matching symbols on a payline or a symbol and a multiplier on a payline. In an optional embodiment for Keno, a qualifying intermediate holding may be any catch out of the quantity of numbers selected after a quantity of numbers have been drawn, such as a catch of four numbers out of seven selected after ten numbers have been drawn.

With continued reference to FIG. 1, a qualifying final result is also designated 42 for each qualifying intermediate holding. The qualifying final result is the final holding required at the end of the base game that results in a payout to the player based on a mid-game wager as discussed below. The qualifying final result is related to the corresponding qualifying intermediate holding in that the qualifying final result is the successful completion of the qualifying intermediate holding held at the intermediate point or intermediate points.

In one optional embodiment, only one qualifying final result is designated for each qualifying intermediate holding. For example, in a video draw poker machine embodiment, if the qualifying intermediate holding is four to a Royal Flush, the qualifying final result is a Royal Flush. Similarly, if the qualifying intermediate holding is three of a kind, the qualifying final result is four of a kind.

It is also contemplated that multiple qualifying final results may correspond to each qualifying intermediate holding. For example, in one optional video draw poker embodiment, the player may be prompted to select the qualifying final result he wishes to wager upon based upon his qualifying intermediate holding. In such an alternate embodiment, a player with four to a Royal Flush may be prompted to select a qualifying final result from a Royal Flush or a straight flush with a corresponding adjustment in payout. Alternatively, the game rules themselves may account for the likelihood of each qualifying final result occurring based on the corresponding qualifying intermediate holding. In such an optional embodiment, a set of poker hands, such as Royal Flush, a straight flush, a straight, and a flush, may all be designated as qualifying final results with corresponding adjustments in payouts, for a qualifying intermediate holding of four to a Royal Flush.

Turning to an optional slot machine embodiment, if the qualifying intermediate holding is two matching symbols on a payline, the qualifying final result may be a matching third symbol on a payline. Similarly, in a slot machine embodiment with multiple paylines, the qualifying intermediate holding could be two matching symbols on one or more paylines and the qualifying final result could be a matching third symbol on one or more paylines. For a Keno machine, if the qualifying intermediate holding is a catch of four of seven selected after ten drawn, the qualifying final result may be six of seven selected.

Referring again to FIG. 1, the player begins game play by placing 20 a base game wager and initiating 22 the base game. The base game is conducted in conventional fashion 24 until the predetermined intermediate point is reached. Upon reaching the intermediate point, the player's holding is compared 30 to the qualifying intermediate holding. If the player possesses a qualifying intermediate holding, an optional mid-game wager becomes available 32 to the player. The mid-game wager is a wager that the player will receive a qualifying final result corresponding to the qualifying intermediate holding he possessed at the intermediate point. It is contemplated that in the rare instance that a player possesses a qualifying intermediate holding that is also a qualifying final result, the player may be allowed to place a mid-game wager or, alternatively, not be allowed to place a mid-game wager as determined by the game rules.

The size of the mid-game wager is not subject to any express limits other than those set by the house depending on the payouts and the desired house advantage. However, it is contemplated that the mid-game wager limit may be adjusted to make the wager attractive to the player.

The base game continues and the player obtains 34 a final holding. In one embodiment of the method, the base wager and mid-game wager are rewarded separately. In such an embodiment, the player is rewarded 38 based his base wager for his final holding according to the rules of the base game. If the player made 36 the optional mid-game wager, the player's final holding is then compared 40 to the qualifying final results corresponding to the player's intermediate holding. If the player's final holding matches a qualifying final result, or a selected qualifying final result in an optional embodiment, the player is also rewarded 46 based on his mid-game wager. It is contemplated that the mid-game wager reward could be any form including a fixed reward, a progressive reward, or any other type of reward. Conversely, if the player's final result does not match a qualified final result, the player's mid-game wager is collected 44.

In an alternate optional embodiment, the base wager and the mid-game wager are summed and rewarded on a predetermined paytable. In other words, the mid-game wager is merely a way to supplement the base wager.

In yet another optional embodiment, the base wager and mid-game wager are somewhat dependent in that winning the mid-game wager bumps the player from a first paytable for those not winning a mid-game wager, to a second paytable for those winning a mid-game wager. That is, rather than being rewarded separately, the player receives a single reward for the combined wager from a second paytable.

In a related optional embodiment, a winning mid-game wager acts to multiply the reward on the base wager. Put another way, a multiplier applied to the base wager reward is the reward associated with the mid-game wager.

It should be noted that it is not enough that the player win the base wager to win the mid-game wager. Rather the player must receive a qualifying final result. For example, in a video draw poker embodiment, if an intermediate qualifying holding is four to a Royal Flush and, at the intermediate point, the player's hand comprises 10♡ J♡ Q♡ K♡ 5♤ and places a mid-game wager with the goal of obtaining a Royal Flush, he will not be rewarded on his mid-game wager for discarding the 5♤ and drawing a K♤ even if he is rewarded on his base wager for a pair of Kings. He will only be rewarded for obtaining a qualifying final result, or a selected qualifying final result in an optional embodiment, corresponding to his qualifying intermediate holding. Players rewarded for obtaining a qualifying final result may be paid at any rate including true odds or more.

Figure 2:
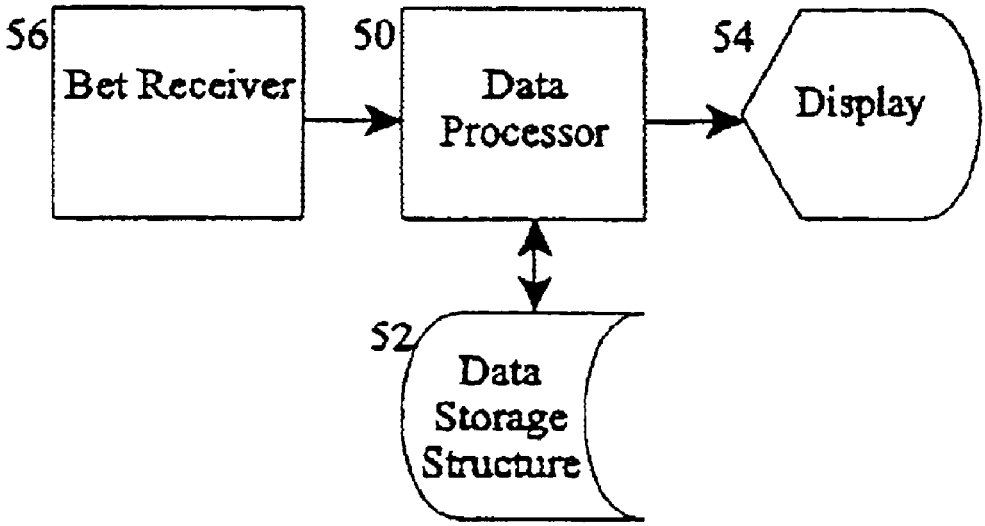
FIG. 2 is a box diagram of a gaming device according to an embodiment of the present invention.

The present invention also embraces a gaming machine for conducting the gaming method described above. With reference to FIG. 2, a gaming machine according to the present invention includes a display 54, a data processor 50 communicating with the display, a data storage structure 52 communicating with the data processor 50, and a bet receiver 56 communicating with the data processor 50. The data storage structure 52 may be any type including optical, magnetic, ROM, EPROM, EAROM, RAM, or any other type of storage. The data storage structure 52 stores instructions embodying the method described above, images used during gameplay, and any other data that may be necessary to make the gaming machine operable.

The data processor initiates game play in response to receiving a wager at the bet receiver 56. The data processor conducts game play and prompts the display 54 to display images according to the conventional conduct of the base game. Upon reaching an intermediate point, the data processor 50 examines the player's holding and determines whether the mid-game wager is available to the player. If the mid-game wager is available, the data processor 50 prompts the player, such as through displaying a message at the display 54, to place a mid-game wager if desired. The data processor monitors to determine whether the mid-game wager was received at the bet receiver 56.

Again, the base game is conducted by the data processor 50 to a final result according to the base game rules stored at the data storage structure 52. Upon reaching a final result, the data processor 50 compares the player's final result to the qualifying final result corresponding to the qualifying intermediate holding possessed by the player at the intermediate point at which the mid-game wager was placed. If the player's final result is a qualifying final result, the data processor 50 directs a reward to be issued to the player based on the mid-game wager.

While certain embodiments of the present invention have been shown and described it is to be understood that the present invention is subject to many modifications and changes without departing from the spirit and scope of the claims presented herein.

I claim:

1. A method for conducting a wagering game applied to a base game, said base game played by a player according to a set of rules that leads to the player obtaining a final result, comprising:

designating an intermediate game point, a qualifying intermediate holding for said intermediate game point, and a qualifying final result corresponding to each qualifying intermediate holding;

the player making a base game wager and indicating the base game;

playing said base game according to said set of rules until reaching a predetermined intermediate game point;

permitting the player to place a mid-game wager only if the player possesses a predetermined qualifying intermediate holding at an intermediate game point;

playing said base game according to said set of rules until the player obtains a final result;

examining the final result and rewarding the player based on said base wager or collecting the player's base wager according to said set of rules; and for a player placing a mid-game wager, rewarding said player based on said mid-game wager only if the player's final result matches a qualifying final result corresponding to the qualifying intermediate holding possessed by the player when said mid-game wager was placed.

2. The method of claim 1 wherein said base game is video draw poker in which a player is dealt an initial holding, discards zero or more cards, and receives replacements for the discarded cards, and an intermediate point includes the point prior to discarding zero or more cards.

3. The method of claim 1 wherein said base game is a slot machine having a plurality of reels with a plurality of symbols thereon, the final position in which the reels stop with respect to one or more paylines determining said final result, and an intermediate point includes a point after at least one reel but fewer than all the reels have stopped.

4. The method of claim 1 wherein said base game is keno in which a player selects a first quantity of numbers and a second quantity of numbers are drawn, the quantity of selected numbers matching the numbers drawn determining said final result, and an intermediate point includes a point after at least one number but fewer than the second quantity of the numbers have been drawn.

5. A method for conducting a wagering game applied to a base game, said base game played by a player according to a set of rules that leads to the player obtaining a final result, comprising:

designating a intermediate game point, a qualifying intermediate holding for each intermediate game point, and a qualifying final result corresponding to each qualifying intermediate holding, at least one of said qualifying intermediate holdings correspond to two or more qualifying final results;

the player making a base game wager and initiating the base game;

playing said base game according to said set of rules until reaching a predetermined intermediate game point;

permitting the player to place a mid-game wager only if the player possesses a predetermined qualifying intermediate holding at the intermediate game point and if the qualifying intermediate holding obtained by the player corresponds to more than one qualifying final holding, the player selecting a qualifying final result corresponding to the qualifying intermediate holding obtained;

playing said base game according to said set of rules until the player obtains a final result;

examining the final result and rewarding the player based on said base wager or collecting the player's base wager according to said set of rules; and for a player placing a mid-game wager, rewarding said player based on said mid-game wager only if the player's final result matches the selected qualifying final result.

6. The method of claim 5 wherein said base game is video draw poker in which a player is dealt an initial holding, discards zero or more cards, and receives replacements for the discarded cards, and an intermediate point includes the point prior to discarding zero or more cards.

7. The method of claim 5 wherein said base game is a slot machine having a plurality of reels with a plurality of symbols thereon, the final position in which the stop with respect to one or more paylines determining said final result, and an intermediate point includes a point after at least one reel but fewer than all the reels have stopped.

8. The method of claim 5 wherein said base game is keno in which a player selects a first quantity of numbers and a second quantity of numbers are drawn, the quantity of selected numbers matching the numbers drawn determining said final result, and an intermediate point includes a point after at least one number but fewer than the second quantity of the numbers have been drawn.

9. A device for conducting a wagering game applied to a base game, said base game played by a player according to a set of rules that leads to the player obtaining a final result, comprising:

a data processor;

a display communicating with said data processor;

a bet receiver communicating with said data processor; and a data storage structure communicating with said data processor, said data storage structure storing said set of rules and instructions for said data processor to conduct said wagering game, wherein said instructions comprise:

designating an intermediate game point, a qualifying intermediate holding for said intermediate game point, and a qualifying final result corresponding to each qualifying intermediate holding;

initiating the base game in response to said data processor;

conducting said base game according to said set of rules until reaching a predetermined intermediate game point;

permitting the player to place a mid-game wager only if the player possesses a predetermined qualifying intermediate holding at an intermediate game point;

conducting said base game according to said set of rules until the player obtains a final result;

examining the final result and rewarding the player based on said base wager or collecting the player's base wager according to said set of rules; and for a player placing a mid-game wager rewarding said player based on said mid-game wager only if the player's final result matches a qualifying final result corresponding to the qualifying intermediate holding possessed by the player when said mid-game wager was placed.

10. The device of claim 9 wherein said base game is video draw poker in which a player is dealt an initial holding, discards zero or more cards, and receives replacements for the discarded cards, and an intermediate point includes the point prior to discarding zero or more cards.

11. The method of claim 9 wherein said base game is a slot machine having a plurality of reels with a plurality of symbols thereon, the final position in which the reels stop with respect to one or more paylines determining said final result, and an intermediate point includes a point after at least one reel but fewer than all the reels have stopped.

12. The method of claim 9 wherein said base game is keno in which a player selects a first quantity of numbers and a second quantity of numbers are drawn, the quantity of selected numbers matching the numbers drawn determining said final result, and an intermediate point includes a point after at least one number but fewer than the second quantity of the numbers have been drawn.

* * * * *